US011142415B2

(12) United States Patent
Lee et al.

(10) Patent No.: US 11,142,415 B2
(45) Date of Patent: Oct. 12, 2021

(54) SHEET SIZE DETECTING MECHANISM

(71) Applicant: PRIMAX ELECTRONICS LTD., Taipei (TW)

(72) Inventors: Chih-Chia Lee, Taipei (TW); Chun-Chi Wang, Taipei (TW); Chao-Min Yang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 162 days.

(21) Appl. No.: 16/735,771

(22) Filed: Jan. 7, 2020

(65) Prior Publication Data

US 2021/0155429 A1 May 27, 2021

(30) Foreign Application Priority Data

Nov. 22, 2019 (TW) ..... 108142588

(51) Int. Cl.
*B65H 1/04* (2006.01)
*B65H 7/02* (2006.01)

(52) U.S. Cl.
CPC ..... *B65H 1/04* (2013.01); *B65H 7/02* (2013.01); *B65H 2405/114* (2013.01); *B65H 2511/12* (2013.01); *B65H 2515/708* (2013.01); *B65H 2553/20* (2013.01)

(58) Field of Classification Search
CPC ... B65H 1/04; B65H 7/00; B65H 7/02; B65H 9/101; B65H 2401/212; B65H 2405/114; B65H 2405/1142; B65H 2405/11425; B65H 2405/1144; B65H 2511/12; B65H 2515/708; B65H 2553/20; B65H 2553/21
See application file for complete search history.

(56) References Cited

U.S. PATENT DOCUMENTS 5,940,106 A * 8/1999 Walker ..... B41J 11/003 347/104
6,267,522 B1 * 7/2001 Slippy ..... B65H 1/04 101/232
2005/0174413 A1 * 8/2005 Shen ..... B65H 1/04 347/104

* cited by examiner

*Primary Examiner* — Prasad V Gokhale
(74) *Attorney, Agent, or Firm* — WPAT, PC

(57) ABSTRACT

A sheet size detecting mechanism includes a sheet guiding module, a sensing module and a control unit. The sensing module includes a contact element and a circuit board. The circuit board includes a first conducting part, a second conducting part and plural fixed resistors. The first conducting part includes plural conductive segments. The plural conductive segments are connected with the corresponding fixed resistors, respectively. While the sheet guiding module is moved relative to the sheet input tray, the contact element is moved with the sheet guiding module. When the electric connection between a first conductive segment and the second conducting part is established through the contact element, the corresponding fixed resistor provides a resistance value, and the circuit board issues a sensing signal according to the resistance value. The control unit acquires the size of the paper sheet according to the sensing signal.

10 Claims, 5 Drawing Sheets

SHEET SIZE DETECTING MECHANISM

FIELD OF THE INVENTION

The present invention relates to a sheet size detecting mechanism, and more particularly to a sheet size detecting mechanism for use in an automatic document feeder.

BACKGROUND OF THE INVENTION

With the maturity of automatic sheet feeding technologies, automatic document feeders are widely used in a diversity of document processing machines such as printers, copiers and multifunction peripherals. An automatic document feeder is used for successively feeding a stack of sheet-like documents into the inner portion of the document processing machine so as to implement associated operations and achieve the labor-saving purpose.

For processing sheet-like documents of various sizes, the automatic document feeder has a sheet size detecting mechanism for detecting the size of the document before the document is fed into the inner portion of the document processing machine. Take a copier for example. There are several paper feeding cassettes accommodating blank paper sheets of various sizes (A3, A4, B4, B5, . . . , etc). For example, in a case that an A4-sized document is selected to be copied by the copier, the sheet size detecting mechanism will detect the size of document in advance and issue a corresponding detecting signal to the copier. In response to the detecting signal, an A4-sized blank paper sheet is automatically provided by the copier, and a copying operation is performed on the A4-sized blank paper sheet.

The conventional sheet size detecting mechanism comprises a sheet input tray and a sensing module. The sheet input tray comprises two opposed guiding elements. The two guiding elements can be moved toward or away from each other to clamp both sides of the paper sheet. The sensing module is installed on the sheet input tray. By moving the guiding element to comply with the width of the paper sheet, the sensing module generates plural digital signals. According to the digital signals, the size of the paper sheet is determined.

However, the sensing module of the conventional sheet size detecting mechanism is a combination of a photo interrupter, a capacitive sensor and a metallic elastic slice to generate a multi-bit digital code. Since the sensing module of the conventional sheet size detecting mechanism comprises many components and sensing units, the fabricating cost is high.

Therefore, there is a need of providing an improved sheet size detecting mechanism to overcome the drawbacks of the conventional technologies.

SUMMARY OF THE INVENTION

The present invention provides a sheet size detecting mechanism that has a simplified structure and reduced cost and is easily assembled.

The other objects and advantages of the present invention will be understood from the disclosed technical features.

In accordance with an aspect of the present invention, a sheet size detecting mechanism for a sheet input tray of an automatic document feeder is provided. The sheet size detecting mechanism includes a sheet guiding module, a sensing module and a control unit. The sheet guiding module is installed on the sheet input tray, and movable relative to the sheet input tray. The sensing module is installed on the sheet input tray. The sensing module includes a contact element and a circuit board. The contact element is connected with the sheet guiding module. The circuit board includes a first conducting part, a second conducting part and plural fixed resistors. The first conducting part includes plural conductive segments. The plural conductive segments are spaced apart. The plural conductive segments are connected with the corresponding fixed resistors, respectively. While the sheet guiding module is moved relative to the sheet input tray and moved in a direction to be contacted with two parallel edge sides of a first paper sheet, the contact element is moved with the sheet guiding module. When the contact element is contacted with a first conductive segment of the plural conductive segments of the first conducting part and the contact element is contacted with the second conducting part, a first fixed resistor of the plural fixed resistors connected with the first conductive segment provides a first resistance value, and the circuit board issues a first sensing signal according to the first resistance value. The control unit receives the first sensing signal and acquires a distance between the two parallel edge sides of the first paper sheet according to the first sensing signal.

While the sheet guiding module is moved relative to the sheet input tray and moved in a direction to be contacted with two parallel edge sides of a second paper sheet, the contact element is moved with the sheet guiding module. When the contact element is contacted with a second conductive segment of the plural conductive segments of the first conducting part and the contact element is contacted with the second conducting part, a second fixed resistor of the plural fixed resistors connected with the second conductive segment provides a second resistance value. The circuit board issues a second sensing signal according to the second resistance value. The control unit acquires a distance between the two parallel edge sides of the second paper sheet according to the second sensing signal. The first resistance value and the second resistance value are different. the distance between the two parallel edge sides of the first paper sheet and the distance between the two parallel edge sides of the second paper sheet are different.

In an embodiment, the sheet guiding module includes a first guiding rack, a second guiding rack and a circular gear. The first guiding rack and the second guiding rack are parallel with each other. The circular gear is arranged between the first guiding rack and the second guiding rack and engaged with the first guiding rack and the second guiding rack. While the first guiding rack is moved in a first linear direction, the circular gear is correspondingly rotated in response to movement of the first guiding rack, and the second guiding rack is correspondingly moved in a second linear direction in response to rotation of the circular gear. The second linear direction is reverse to the first linear direction.

In an embodiment, the first guiding rack, the second guiding rack and the circular gear are arranged along a first axial direction, the first guiding rack and the second guiding rack are extended along a second axial direction, and the first guiding rack and the circuit board are arranged along a third axial direction. The first axial direction, the second axial direction and the third axial direction are perpendicular to each other. There is a gap between the first guiding rack and the circuit board along the third axial direction.

In an embodiment, the contact element is connected with the first guiding rack. While the first guiding rack is moved in the first linear direction, the contact element is moved with the first guiding rack and moved in the first linear direction.

In an embodiment, an arranging direction of the plural conductive segments of the first conducting part is parallel with the first linear direction, and an extending direction of the second conducting part is parallel with the first linear direction. The arranging direction and the extending direction are parallel with each other.

In an embodiment, the sheet guiding module further includes a first guiding element and a second guiding element. The first guiding element is connected with the first guiding rack and located at a first end of the sheet input tray. The second guiding element is connected with the second guiding rack and located at a second end of the sheet input tray. The first end and the second end of the sheet input tray are opposed to each other. While the first guiding rack is moved in the first linear direction, the first guiding element is moved with the first guiding rack and moved relative to the sheet input tray in the first linear direction. While the second guiding rack is moved in the second linear direction, the second guiding element is moved with the second guiding rack and moved relative to the sheet input tray in the second linear direction. As the first guiding element is moved in the first linear direction and the second guiding element is moved in the second linear direction, the first guiding element and the second guiding element are moved toward each other so as to be contacted with the two parallel edge sides of the first paper sheet.

In an embodiment, the contact element includes a first pin and a second pin, and the first pin and the second pin are bent toward the circuit board. While the sheet guiding module is moved relative to the sheet input tray and contacted with the two parallel edge sides of the first paper sheet, the contact element is moved with the sheet guiding module, so that the first pin is contacted with the first conductive segment of the plural conductive segments of the first conducting part and the second pin is contacted with the second conducting part.

In an embodiment, the contact element is an elastic element, wherein in response to an elastic restoring force of the elastic element, the first pin and the second pin are in close contact with the first conductive segment of the plural conductive segments of the first conducting part and the second conducting part, respectively.

In an embodiment, the control unit includes an analog/digital converter, and the first sensing signal is converted into a digital signal by the analog/digital converter.

From the above descriptions, the present invention provides the sheet size detecting mechanism. While the sheet guiding module is moved relative to the sheet input tray and contacted with the two parallel edge sides of the paper sheet, the contact element is moved relative to the circuit board. When the contact element is contacted with a specified conductive segment of the first conducting part and the contact element is contacted with the second conducting part, the corresponding fixed resistor connected with the specified conductive segment has a corresponding resistance value. According to the resistance value, the control unit acquires the distance between the two parallel edge sides of the paper sheet (i.e., the size of the paper sheet). When the sheet guiding module is moved relative to the sheet input tray and moved to a different position, the contact element connected with the sheet guiding module is contacted with a different conductive segment of the first conducting part. Consequently, the corresponding fixed resistor connected with the specified conductive segment has a different resistance value. Moreover, the sensing module comprises the contact element (e.g., a metallic elastic element) and the circuit board, and the circuit board is only equipped with the first conducting part, the second conducting part and a small number of fixed resistors. In other words, the structure of the sensing module is simplified. During the assembling process, the associated components can be precisely positioned and assembled without the need of using an additional jig tool. After the assembling process, the complicated calibrating procedure and adjusting procedure are not necessary. Consequently, the fabricating cost is effectively reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
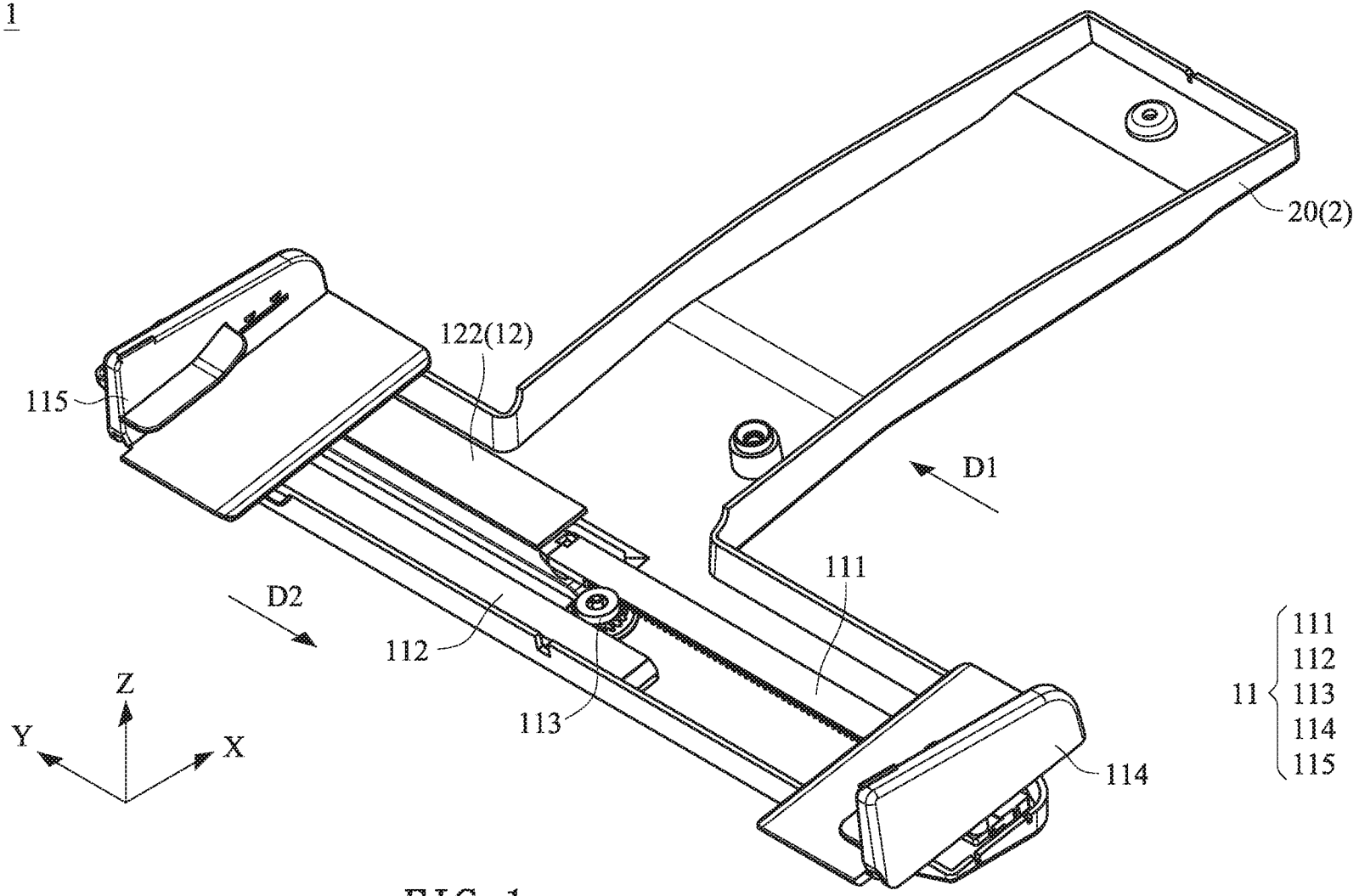
FIG. 1 is a schematic perspective view illustrating a sheet size detecting mechanism installed on a sheet input tray of an automatic document feeder according to an embodiment of the present invention.
Figure 2:
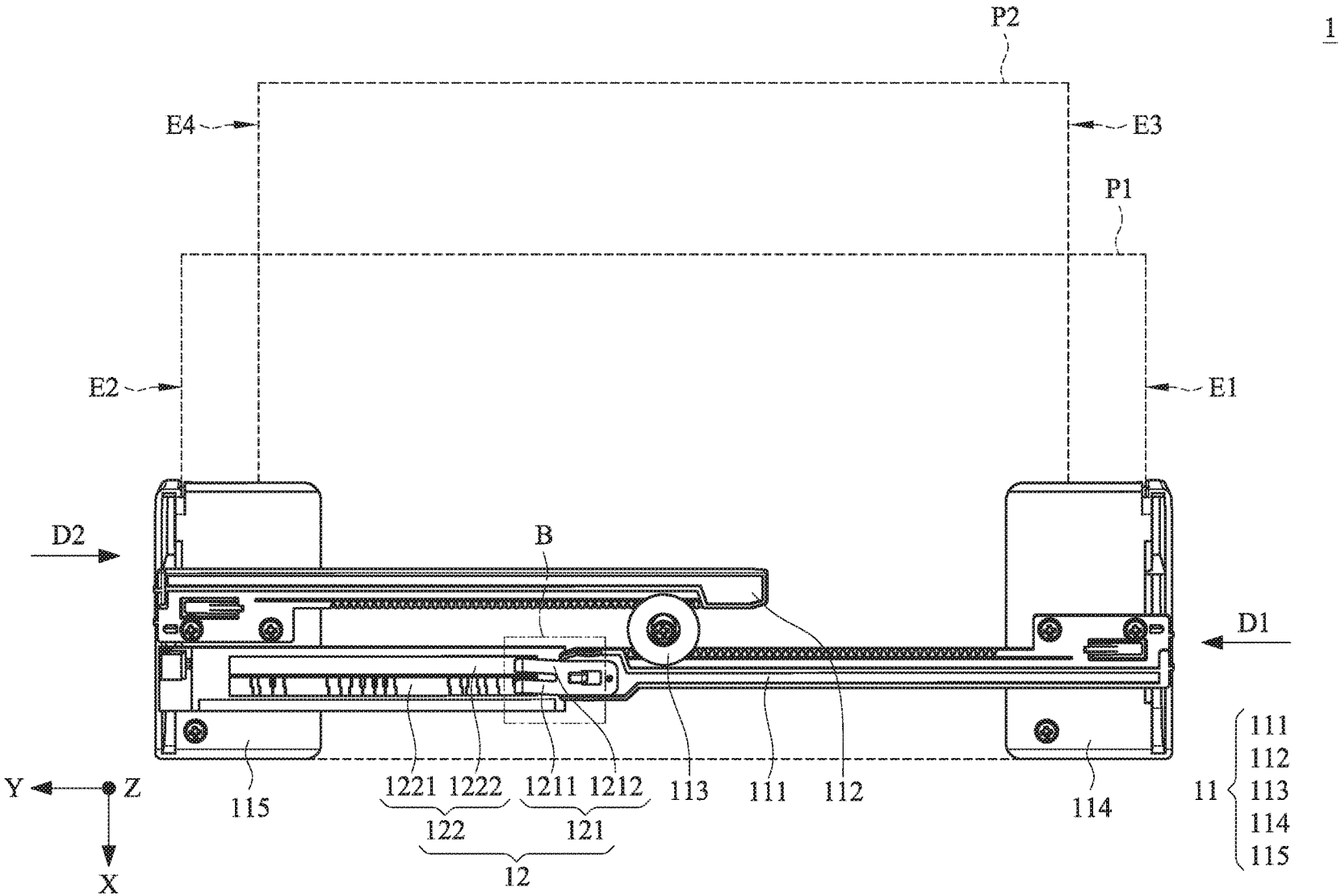
FIG. 2 is a schematic top view illustrating the sheet size detecting mechanism as shown in FIG. 1.
Figure 3:
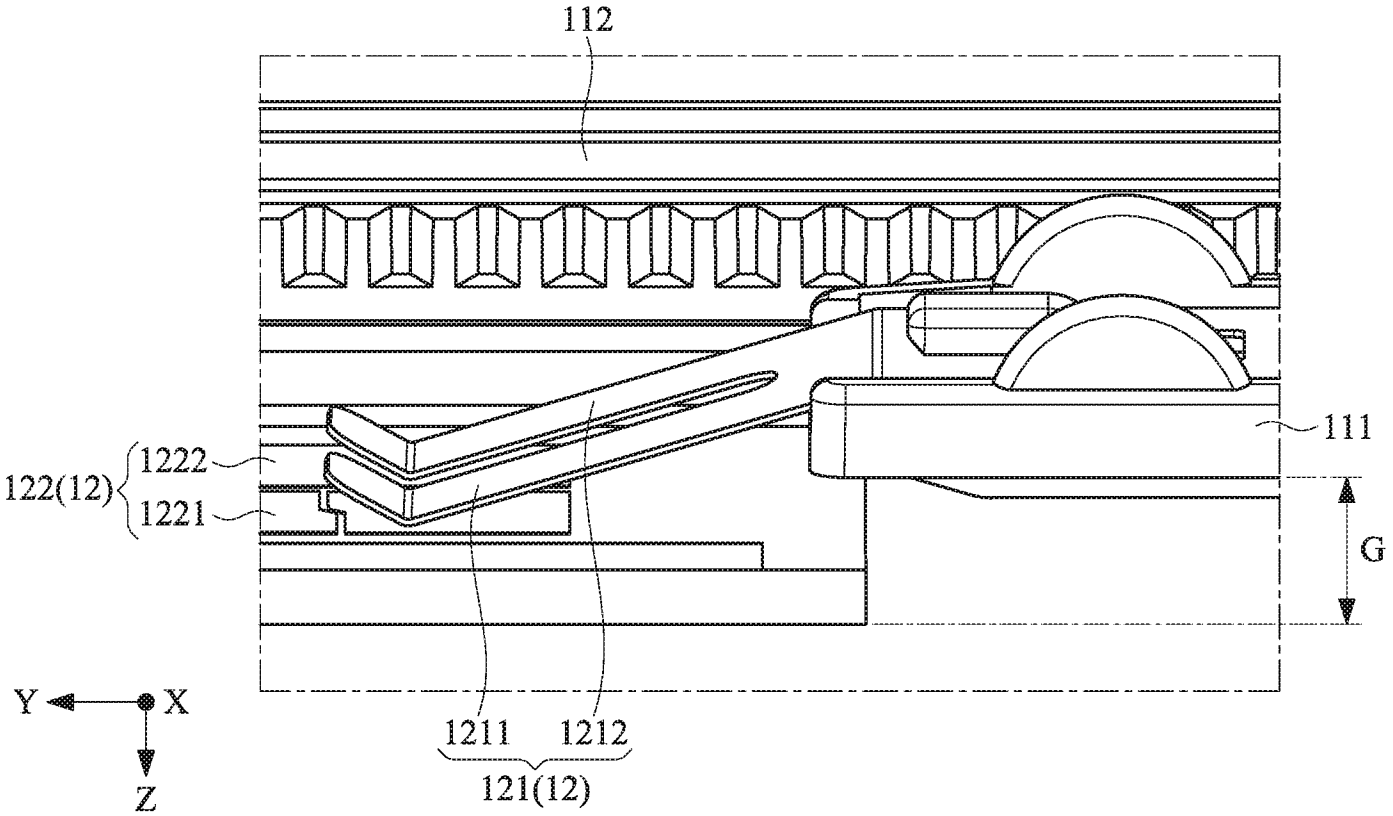
FIG. 3 is a schematic side view illustrating the enlarged portion of a region B of the sheet size detecting mechanism as shown in FIG. 2.
Figure 4:
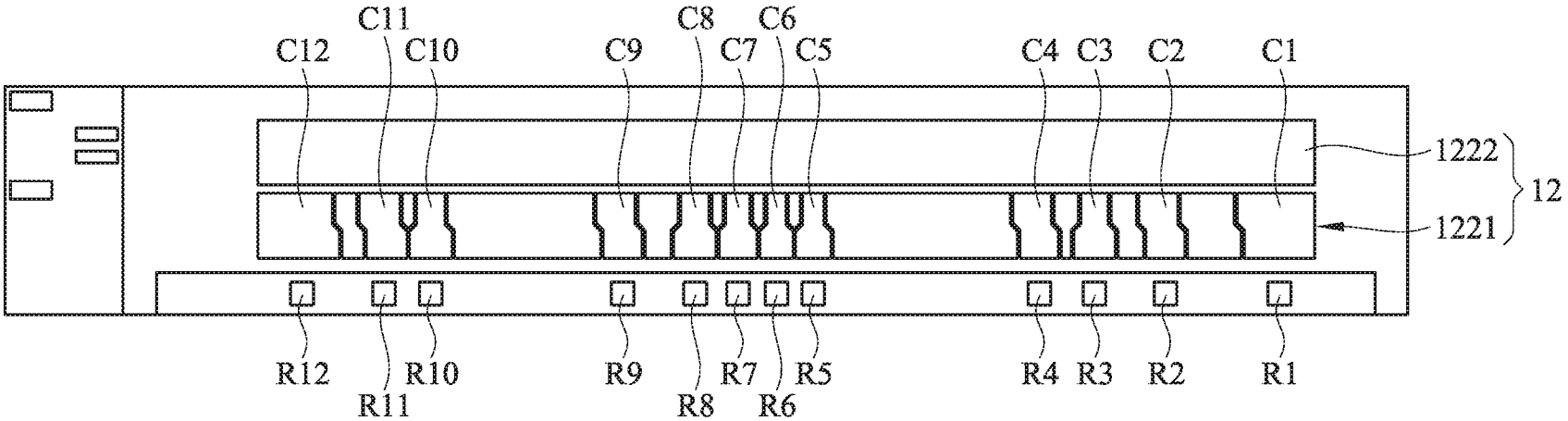
FIG. 4 schematically illustrates the structure of the circuit board of the sheet size detecting mechanism as shown in FIG. 2.
Figure 5:
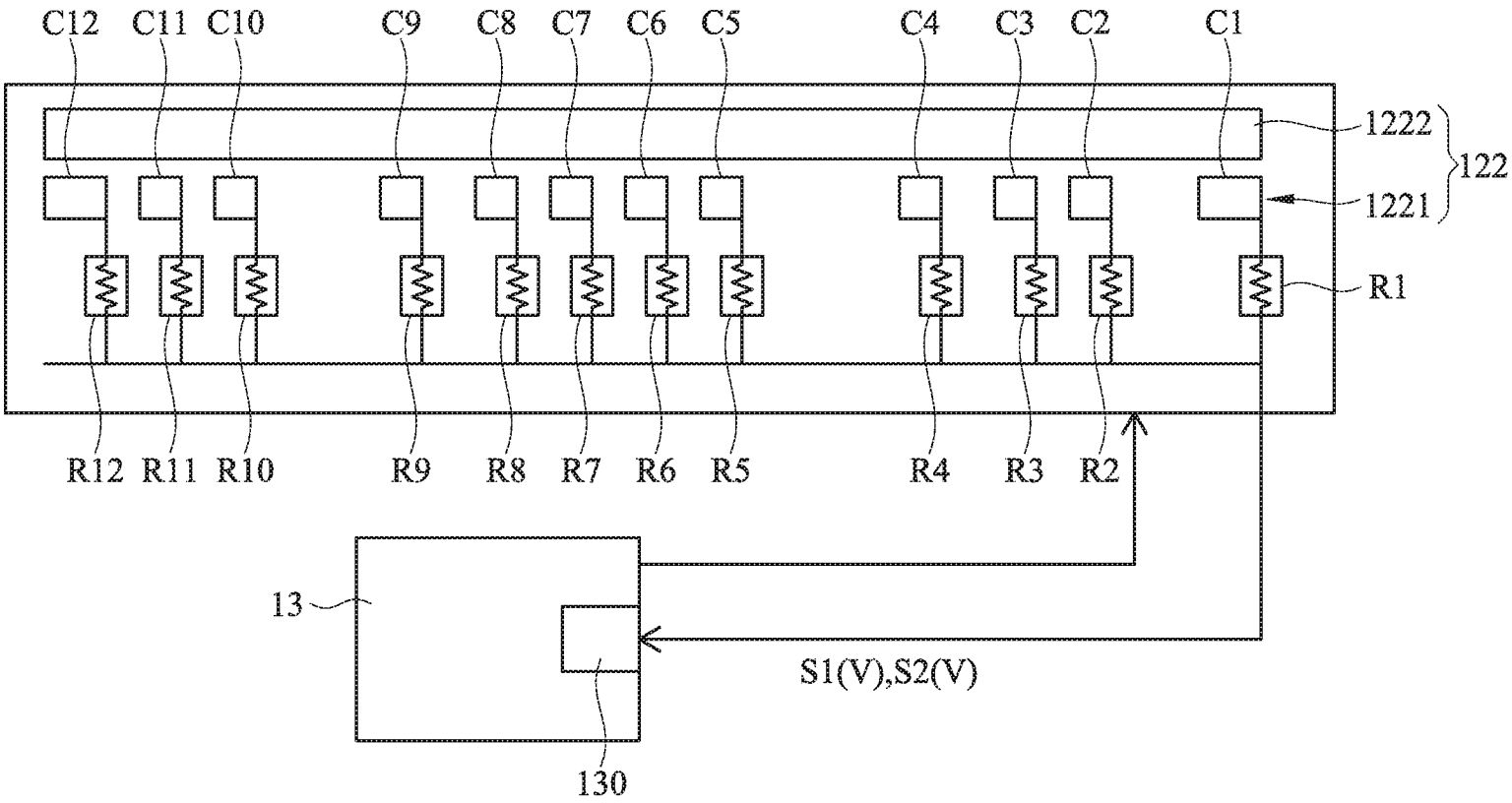
FIG. 5 is schematic circuit block diagram illustrating the sheet size detecting mechanism as shown in FIG. 2.

Please refer to FIGS. 1, 2, 3, 4 and 5. FIG. 1 is a schematic perspective view illustrating a sheet size detecting mechanism installed on a sheet input tray of an automatic document feeder according to an embodiment of the present invention. FIG. 2 is a schematic top view illustrating the sheet size detecting mechanism as shown in FIG. 1. FIG. 3 is a schematic side view illustrating the enlarged portion of a region B of the sheet size detecting mechanism as shown in FIG. 2. FIG. 4 schematically illustrates the structure of the circuit board of the sheet size detecting mechanism as shown in FIG. 2. FIG. 5 is schematic circuit block diagram illustrating the sheet size detecting mechanism as shown in FIG. 2. The automatic document feeder 2 comprises a sheet input tray 20 and a sheet size detecting mechanism 1. For clearly showing the structure of the sheet size detecting mechanism 1, a portion of the casing of the sheet input tray 20 is not shown in FIG. 1 and the entire of the sheet input tray 20 is not shown in FIG. 2.

As shown in FIGS. 1, 2, 3, 4 and 5, the sheet size detecting mechanism 1 comprises a sheet guiding module 11, a sensing module 12 and a control unit 13. The sheet guiding module 11 is installed on the sheet input tray 20 of the automatic document feeder 2. The sheet guiding module 11 is movable relative to the sheet input tray 20. The sensing module 12 is installed on the sheet input tray 20. The sensing module 12 comprises a contact element 121 and a circuit board 122. The contact element 121 is connected with the sheet guiding module 11. The circuit board 122 comprises a first conducting part 1221, a second conducting part 1222 and plural fixed resistors R1~R12. The first conducting part 1221 comprises plural conductive segments C1~C12. These conductive segments C1~C12 are spaced apart. Moreover, these conductive segments C1~C12 are connected with the corresponding fixed resistors R1·R12, respectively.

After a paper sheet P1 is placed on the sheet input tray 20, the user may move the sheet guiding module 11 relative to the sheet input tray 20. Consequently, the sheet guiding module 11 is contacted with two parallel edge sides E1 and E2 of the paper sheet P1. Moreover, while the contact element 121 is moved with the sheet guiding module 11, the contact element 121 is contacted with the first conductive segment C1 of the first conducting part 1221 and the contact element 121 is contacted with the second conducting part 1222. When the electric connection between the first conductive segment C1 and the second conducting part 1222 is established through the contact element 121, the fixed resistor R1 connected with the first conductive segment C1 provides a first resistance value and the circuit board 122 issues a first sensing signal S1 to the control unit 13. According to the first sensing signal S1 from the circuit board 122, the control unit 13 acquires the distance between the two parallel edge sides E1 and E2 of the paper sheet P1.

After a paper sheet P2 is placed on the sheet input tray 20, the user may move the sheet guiding module 11 relative to the sheet input tray 20. Consequently, the sheet guiding module 11 is contacted with two parallel edge sides E3 and E4 of the paper sheet P2. Moreover, while the contact element 121 is moved with the sheet guiding module 11, the contact element 121 is contacted with the fourth conductive segment C4 of the first conducting part 1221 and the contact element 121 is contacted with the second conducting part 1222. When the electric connection between the fourth conductive segment C4 and the second conducting part 1222 is established through the contact element 121, the fixed resistor R4 connected with the fourth conductive segment C4 provides a second resistance value and the circuit board 122 issues a second sensing signal S2 to the control unit 13. According to the second sensing signal S2 from the circuit board 122, the control unit 13 acquires the distance between the two parallel edge sides E3 and E4 of the paper sheet P2.

The first resistance value of the fixed resistor R1 and the second resistance value of the fixed resistor R4 are different. In addition, the distance between the two parallel edge sides E1 and E2 of the paper sheet P1 and the distance between the two parallel edge sides E3 and E4 of the paper sheet P2 are different.

As mentioned above, after any conductive segment and the second conducting part 1222 are electrically connected with each other through the contact element 121, the sensing signal is generated according to the resistance value of the fixed resistor of the corresponding conductive segment. Due to the structural design, the resistance value of the fixed resistor corresponding to the conductive segment which is contacted with the contact element 121 is stable and precise. In such way, the control unit 13 will not erroneously judge the resistance value. However, if the conductive segments C1~C12 of the first conducting part 1221 are formed as variable resistors by printing carbon films, the same conductive segment may result in the unfixed resistance value. Consequently, the misjudgment problem of the control unit 13 is generated.

The structure of the sheet size detecting mechanism 1 will be described in more details as follows.

Please refer to FIGS. 1 and 2 again. The sheet guiding module 11 comprises a first guiding rack 111, a second guiding rack 112 and a circular gear 113. The first guiding rack 111 and the second guiding rack 112 are parallel with each other. The circular gear 113 is arranged between the first guiding rack 111 and the second guiding rack 112, and engaged with the first guiding rack 111 and the second guiding rack 112. As the first guiding rack 111 is moved in a first linear direction D1, the circular gear 113 is rotated with the linear movement of the first guiding rack 111. As the circular gear 113 is rotated, the second guiding rack 112 is moved in a second linear direction D2, which is reverse to the first linear direction D1. That is, the first guiding rack 111 and the second guiding rack 112 are synchronously moved in reverse directions.

Please refer to FIGS. 1 and 2 again. In this embodiment, the sheet guiding module 11 further comprises a first guiding element 114 and a second guiding element 115. The first guiding element 114 is connected with the first guiding rack 111 and located at a first end of the sheet input tray 20. The second guiding element 115 is connected with the second guiding rack 112 and located at a second end of the sheet input tray 20. The first end and the second end of the sheet input tray 20 are opposed to each other. The surface of the first guiding element 114 to be contacted with the paper sheet and the surface of the second guiding element 115 to be contacted with the paper sheet are opposed to each other. While the first guiding rack 111 is moved in the first linear direction D1, the first guiding element 114 is moved with the first guiding rack 111 and moved relative to the sheet input tray 20 in the first linear direction D1. While the second guiding rack 112 is moved in the second linear direction D2, the second guiding element 115 is moved with the second guiding rack 112 and moved relative to the sheet input tray 20 in the second linear direction D2. Consequently, the first guiding element 114 and the second guiding element 115 are moved toward each other so as to be contacted with the two parallel edge sides E1 and E2 of the paper sheet P1 or the two parallel edge sides E3 and E4 of the paper sheet P2.

Please refer to FIGS. 1, 2 and 3 again. The contact element 121 is connected with the first guiding rack 111. Moreover, the contact element 121 comprises a first pin 1211 and a second pin 1212. The first pin 1211 and the second pin 1212 are bent toward the circuit board 122. Particularly, the first pin 1211 is contacted with the first conducting part 1221 of the circuit board 122, and the second pin 1212 is contacted with the second conducting part 1222 of the circuit board 122. While the first guiding element 114 and the second guiding element 115 of the sheet guiding module 11 are moved toward each other, the first guiding rack 111 is moved in the first linear direction D1 and the contact element 121 is correspondingly moved in the first linear direction D1. Until the first guiding element 114 and the second guiding element 115 are contacted with the two parallel edge sides E1 and E2 of the paper sheet P1, the first pin 1211 is contacted with the first conductive segment C1 of the first conducting part 1221, and the second pin 1212 is contacted with the second conducting part 1222.

Preferably but not exclusively, the contact element 121 is an elastic element. In response to the elastic restoring force of the elastic element, the first pin 1211 and the second pin 1212 are in close contact with the first conducting part 1221 and the second conducting part 1222, respectively.

Please refer to FIGS. 1, 2 and 3 again. The first guiding rack 111, the circular gear 113 and the second guiding rack 112 of the sheet guiding module 11 are arranged along a first axial direction X sequentially. The first guiding rack 111 and the second guiding rack 112 are extended along a second axial direction Y. The first guiding rack 111 and the circuit board 122 are arranged along a third axial direction Z. The first axial direction X, the second axial direction Y and the third axial direction Z are perpendicular to each other. Moreover, there is a gap G between the first guiding rack 111 and the circuit board 122 along the third axial direction Z. That is, the first guiding rack 111 and the circuit board 122 are not coplanar to each other. While the first guiding rack 111 is moved in the first linear direction D1 and the contact element 121 is contacted with the first conducting part 1221 and the second conducting part 1222, a portion of the first guiding rack 111 is overlapped with the circuit board 122.

As shown in FIG. 2 and FIG. 4, the second conducting part 1222 of the circuit board 122 has a rectangular structure. Moreover, the extending direction of the rectangular second conducting part 1222 is parallel with the moving direction of the first guiding rack 111 (i.e., the first linear direction D1). The arranging direction of the conductive segments C1~C12 of the first conducting part 1221 of the circuit board 122 is also parallel with the first linear direction D1. That is, these conductive segments C1~C12 are discontinuous strip-shaped structures. It is noted that the profiles of the first conducting part 1221 and the second conducting part 1222 are not restricted. That is, the profiles of the first conducting part 1221 and the second conducting part 1222 may be varied according to the action design of the sheet guiding module 11.

Please refer to FIG. 5. When the first pin 1211 is contacted with a specified conductive segment of the first conducting part 1221 and the second pin 1212 is contacted with the second conducting part 1222, the fixed resistor corresponding to the specified conductive segment has the corresponding resistance value. According to the resistance value, the circuit board 122 issues a corresponding sensing signal (e.g., the first sensing signal S1 or the second sensing signal S2) to the control unit 13. In an embodiment, the sensing signal is a voltage value. When the first pin 1211 is contacted with a different conductive segment, the fixed resistor corresponding to the conductive segment has a different resistance value. Moreover, a voltage divider circuit is defined by the inner resistor (not shown) of the control unit 133 and the circuit board 122. According to the received voltage value, the control unit 13 recognizes the conductive segment which is contacted with the first pin 1211. Consequently, the control circuit 13 realizes the moving directions of the first guiding rack 111 and the second guiding rack 112 in the reverse directions.

In an embodiment, the control unit 13 comprises an analog/digital converter 130 for converting the voltage value (i.e., the sensing signal) into the digital signal.

From the above descriptions, the present invention provides the sheet size detecting mechanism. While the sheet guiding module is moved relative to the sheet input tray and contacted with the two parallel edge sides of the paper sheet, the contact element is moved relative to the circuit board. When the contact element is contacted with a specified conductive segment of the first conducting part and the contact element is contacted with the second conducting part, the corresponding fixed resistor connected with the specified conductive segment has a corresponding resistance value. According to the resistance value, the control unit acquires the distance between the two parallel edge sides of the paper sheet (i.e., the size of the paper sheet). When the sheet guiding module is moved relative to the sheet input tray and moved to a different position, the contact element connected with the sheet guiding module is contacted with a different conductive segment of the first conducting part. Consequently, the corresponding fixed resistor connected with the specified conductive segment has a different resistance value. Moreover, the sensing module comprises the contact element (e.g., a metallic elastic element) and the circuit board, and the circuit board is only equipped with the first conducting part, the second conducting part and a small number of fixed resistors. In other words, the structure of the sensing module is simplified. During the assembling process, the associated components can be precisely positioned and assembled without the need of using an additional jig tool. After the assembling process, the complicated calibrating procedure and adjusting procedure are not necessary. Consequently, the fabricating cost is effectively reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet size detecting mechanism for a sheet input tray of an automatic document feeder, the sheet size detecting mechanism comprising:

a sheet guiding module installed on the sheet input tray, and movable relative to the sheet input tray;

a sensing module installed on the sheet input tray, and comprising a contact element and a circuit board, wherein the contact element is connected with the sheet guiding module, the circuit board comprises a first conducting part, a second conducting part and plural fixed resistors, and the first conducting part comprises plural conductive segments, wherein the plural conductive segments are spaced apart, and the plural conductive segments are connected with the corresponding fixed resistors, respectively, wherein while the sheet guiding module is moved relative to the sheet input tray and moved in a direction to be contacted with two parallel edge sides of a first paper sheet, the contact element is moved with the sheet guiding module, wherein when the contact element is contacted with a first conductive segment of the plural conductive segments of the first conducting part and the contact element is contacted with the second conducting part, a first fixed resistor of the plural fixed resistors connected with the first conductive segment provides a first resistance value, and the circuit board issues a first sensing signal according to the first resistance value; and a control unit receiving the first sensing signal and acquiring a distance between the two parallel edge sides of the first paper sheet according to the first sensing signal.

2. The sheet size detecting mechanism according to claim 1, wherein while the sheet guiding module is moved relative to the sheet input tray and moved in a direction to be contacted with two parallel edge sides of a second paper sheet, the contact element is moved with the sheet guiding module, wherein when the contact element is contacted with a second conductive segment of the plural conductive segments of the first conducting part and the contact element is contacted with the second conducting part, a second fixed resistor of the plural fixed resistors connected with the second conductive segment provides a second resistance value, wherein the circuit board issues a second sensing signal according to the second resistance value, and the control unit acquires a distance between the two parallel edge sides of the second paper sheet according to the second sensing signal, wherein the first resistance value and the second resistance value are different, and the distance between the two parallel edge sides of the first paper sheet and the distance between the two parallel edge sides of the second sheet are different.

3. The sheet size detecting mechanism according to claim 1, wherein the sheet guiding module comprises a first guiding rack, a second guiding rack and a circular gear, wherein the first guiding rack and the second guiding rack are parallel with each other, and the circular gear is arranged between the first guiding rack and the second guiding rack and engaged with the first guiding rack and the second guiding rack, wherein while the first guiding rack is moved in a first linear direction, the circular gear is correspondingly rotated in response to movement of the first guiding rack, and the second guiding rack is correspondingly moved in a second linear direction in response to rotation of the circular gear, wherein the second linear direction is reverse to the first linear direction.

4. The sheet size detecting mechanism according to claim 3, wherein the first guiding rack, the second guiding rack and the circular gear are arranged along a first axial direction, the first guiding rack and the second guiding rack are extended along a second axial direction, and the first guiding rack and the circuit board are arranged along a third axial direction, wherein the first axial direction, the second axial direction and the third axial direction are perpendicular to each other, and there is a gap between the first guiding rack and the circuit board along the third axial direction.

5. The sheet size detecting mechanism according to claim 3, wherein the contact element is connected with the first guiding rack, wherein while the first guiding rack is moved in the first linear direction, the contact element is moved with the first guiding rack and moved in the first linear direction.

6. The sheet size detecting mechanism according to claim 3, wherein an arranging direction of the plural conductive segments of the first conducting part is parallel with the first linear direction, and an extending direction of the second conducting part is parallel with the first linear direction, wherein the arranging direction and the extending direction are parallel with each other.

7. The sheet size detecting mechanism according to claim 3, wherein the sheet guiding module further comprises a first guiding element and a second guiding element, wherein the first guiding element is connected with the first guiding rack and located at a first end of the sheet input tray, the second guiding element is connected with the second guiding rack and located at a second end of the sheet input tray, and the first end and the second end of the sheet input tray are opposed to each other, wherein while the first guiding rack is moved in the first linear direction, the first guiding element is moved with the first guiding rack and moved relative to the sheet input tray in the first linear direction, wherein while the second guiding rack is moved in the second linear direction, the second guiding element is moved with the second guiding rack and moved relative to the sheet input tray in the second linear direction, wherein as the first guiding element is moved in the first linear direction and the second guiding element is moved in the second linear direction, the first guiding element and the second guiding element are moved toward each other so as to be contacted with the two parallel edge sides of the first paper sheet.

8. The sheet size detecting mechanism according to claim 1, wherein the contact element comprises a first pin and a second pin, and the first pin and the second pin are bent toward the circuit board, wherein while the sheet guiding module is moved relative to the sheet input tray and contacted with the two parallel edge sides of the first paper sheet, the contact element is moved with the sheet guiding module, so that the first pin is contacted with the first conductive segment of the plural conductive segments of the first conducting part and the second pin is contacted with the second conducting part.

9. The sheet size detecting mechanism according to claim 8, wherein the contact element is an elastic element, wherein in response to an elastic restoring force of the elastic element, the first pin and the second pin are in close contact with the first conductive segment of the plural conductive segments of the first conducting part and the second conducting part, respectively.

10. The sheet size detecting mechanism according to claim 1, wherein the control unit comprises an analog/digital converter, and the first sensing signal is converted into a digital signal by the analog/digital converter.

* * * * *